United States Patent [19]

Ottosson

[11] Patent Number: 4,759,085

[45] Date of Patent: Jul. 26, 1988

[54] FLUSHER DISINFECTOR FOR BED-PANS

[75] Inventor: Bertil S. P. Ottosson, Växjö, Sweden

[73] Assignee: Aktiebolaget Electrolux, Sweden

[21] Appl. No.: 68,327

[22] Filed: Jul. 1, 1987

[30] Foreign Application Priority Data

Aug. 15, 1986 [SE] Sweden ..... 8603441

[51] Int. Cl.[4] ..... A61G 9/00; E03D 3/00

[52] U.S. Cl. ..... 4/300.2; 4/661

[58] Field of Search ..... 4/300.2, 300, 661

[56] References Cited

U.S. PATENT DOCUMENTS 1,597,129 8/1926 Watters ..... 4/300.2

FOREIGN PATENT DOCUMENTS

| | | | |
|---|---|---|---|
| 0019204 | 11/1980 | European Pat. Off. | 4/300.2 |
| 2460065 | 6/1976 | Fed. Rep. of Germany | 4/300.2 |
| 3209305 | 9/1983 | Fed. Rep. of Germany | 4/300.2 |
| 0356240 | 1/1938 | Italy | 4/300.2 |
| 0188819 | 4/1964 | Sweden | 4/300.2 |
| 0765676 | 1/1957 | United Kingdom | 4/300.2 |
| 1390018 | 4/1975 | United Kingdom | 4/300.2 |

*Primary Examiner*—Henry K. Artis

*Attorney, Agent, or Firm*—Alfred E. Miller

[57] ABSTRACT

A flusher disinfector for emptying, cleaning and disinfecting of a bed-pan (20) is provided with a device (16,36) which turns the bed-pan and moves the turned bed-pan over a nozzle (58), so that all interior surfaces of the bed-pan is sprayed by direct liquid jets from the nozzle.

4 Claims, 2 Drawing Sheets

FLUSHER DISINFECTOR FOR BED-PANS

The invention relates to an apparatus for empyting and cleaning of a bed-pan and comprising a receptacle, a holder arranged in the receptacle to receive a bed-pan in a position where the contents of the bed-pan is substantially kept in the bed-pan, the holder being connected to a motor-operated device which, when being activated, is arranged to turn the holder with the bed-pan so that the contents of the bed-pan is emptied into the receptacle, and a nozzle to spray a cleaning liquid against the interior of the turned bed-pan.

Such an apparatus, which also is called a flusher disinfector, is known through e.g. DE-Auslegeschrift No. 1 004 775. In this known apparatus the bed-pan is turned 180° and thereby emptied of its contents. The interior of the bed-pan is cleaned by spraying of a cleaning liquid from a nozzle 5, which is positioned outside the interior of the bed-pan. The interior of a bed-pan often shows, however, an undercut form which makes it difficult for liquid jets coming from a nozzle positioned outside the interior of the bed-pan to directly hit and effectively clean all surfaces of the bed-pan.

This drawback is eliminated by the apparatus according to the invention thereby that the motor-operated device is such, that it when being further activated, moves the holder with the bed-pan over the nozzle so that the nozzle protrudes into the interior of the bed-pan when the bed-pan is turned to its emptying position.

By this the nozzle comes inside the mouth brim of the bed-pan and can effectively spray all surfaces of the interior of the bed-pan.

Figure 1:
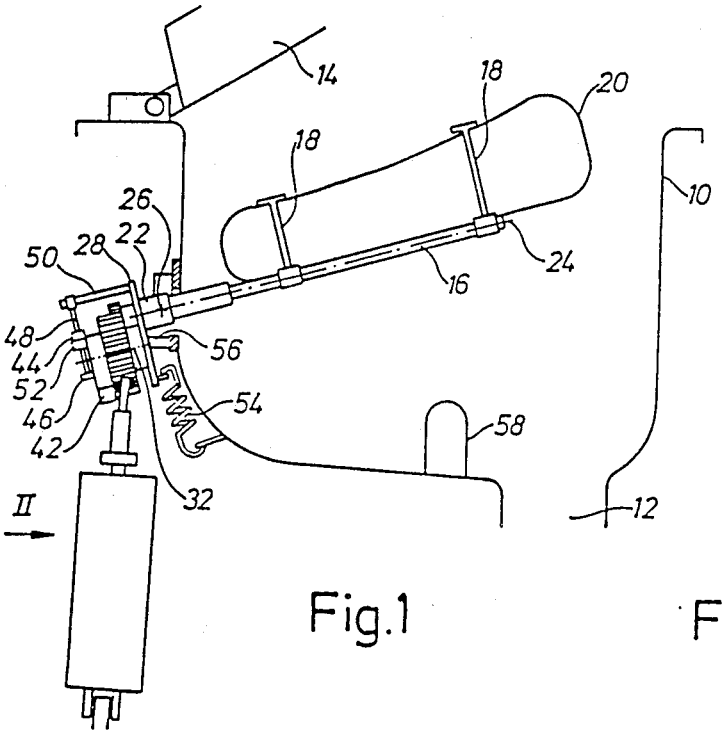
Figure 2:
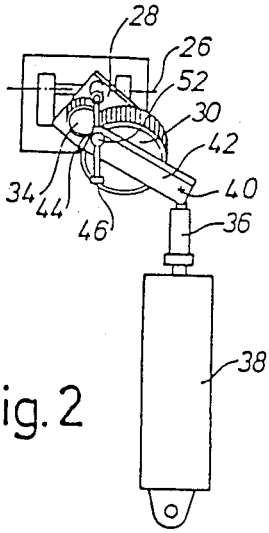
Figure 3:
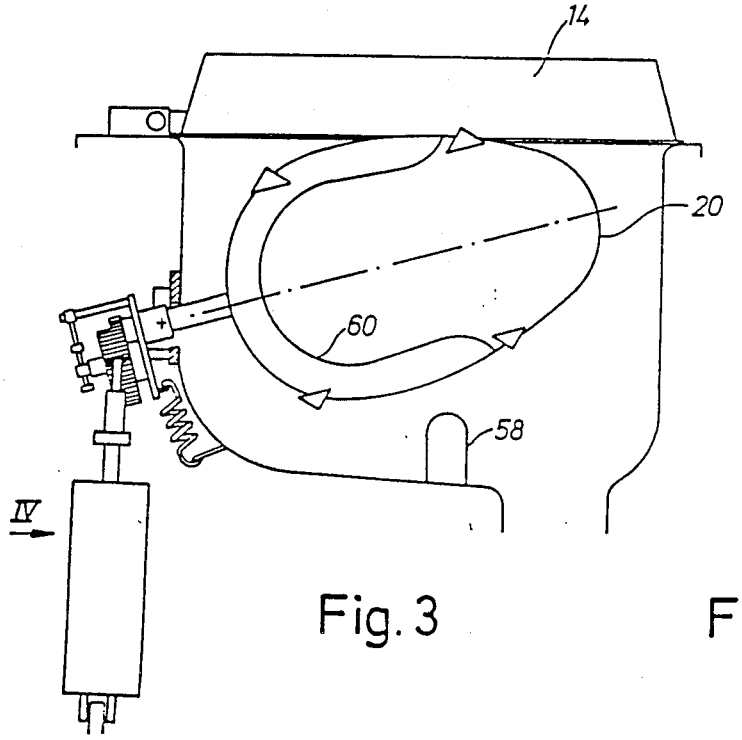
Figure 4:
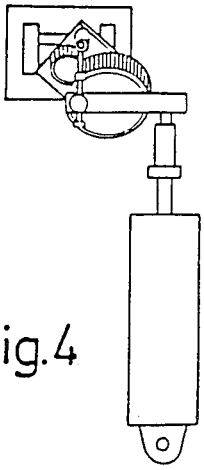
Figure 5:
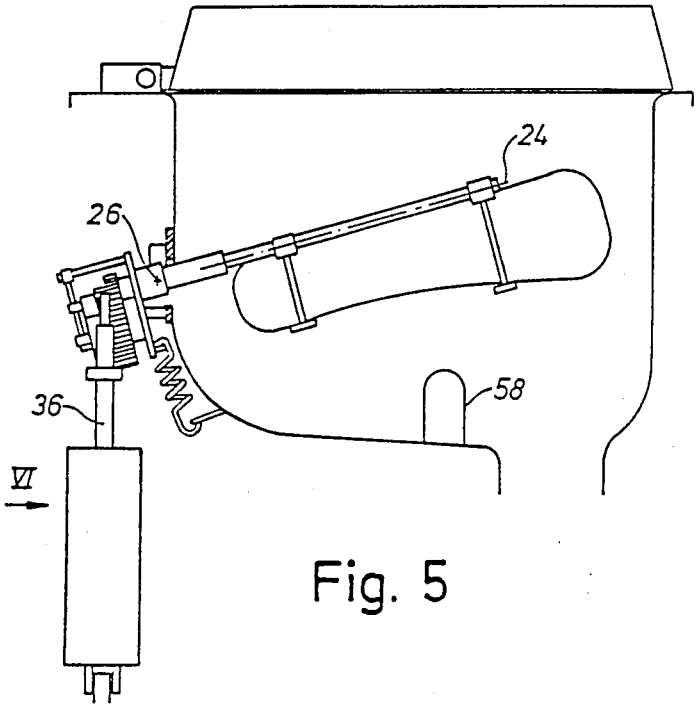
Figure 6:
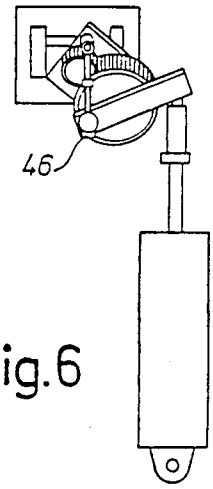
Figure 7:
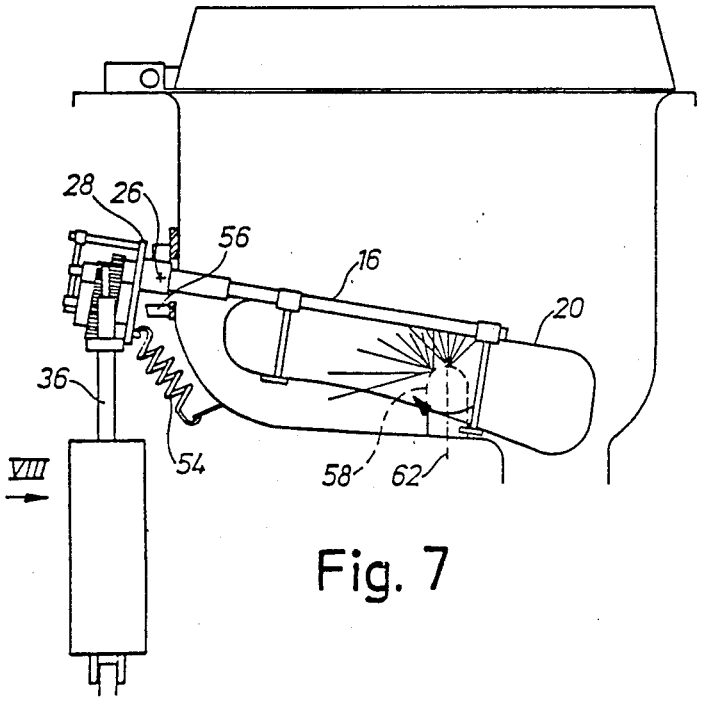
Figure 8:
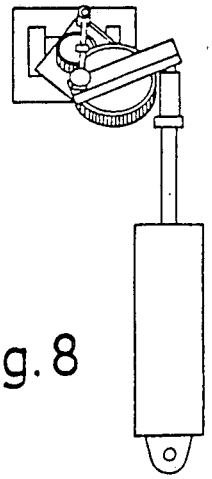

An embodiment of an apparatus according to the invention will be described below in connection with the enclosed drawings, in which FIG. 1 shows a bed-pan clamped in a holder, FIG. 2 shows a view according to the marking II in FIG. 1 of a device for turning the bed-pan, FIG. 3 shows the bed-pan turned 90°, FIG. 4 shows a view according to the marking IV in FIG. 3, FIG. 5 shows the bed-pan turned 180°, FIG. 6 shows a view according to the marking VI in FIG. 5, FIG. 7 shows the bed-pan in a position, where it is lowered over a nozzle, and FIG. 8 shows a view according to the marking VIII in FIG. 7.

Numeral 10 designates a receptacle which is provided with an outlet 12 and is closable by a lid 14. A rod 16 extends into the receptacle. The rod 16, which is provided with a holder 18 for a bed-pan 20, is rotatably journalled in a sleeve 22 around an axis 24. The sleeve 22 is rotatably journalled at the side of the receptacle 10 around a horizontal axis 26.

The sleeve 22 is fastened to a plate 28 on which a gear wheel 30 is rotatably journalled around an axis 32 being parallel with the axis 24. The gear wheel 30 cooperates with a gear wheel 34 which is fastened to the rod 16. The gear wheel 30 is drivable by the piston rod 36 of a fluid cylinder 38, which piston rod 36 through a joint 40 acts on an arm 42 fastened to the gear wheel 30.

The rotary movement of the rod 16 around the axis 24 is limited by two stops 44 and 46 which are arranged on a rod 48. The rod 48 is rotatably journalled on a pin 50 fastened to the plate 28 and is slidably journalled in a pin 52 on the arm 42. The stops 44 and 46 limit the rotary movement of the arm 42 and by that the rotary movement of the gear wheel 30 so that the rotary movement of the gear wheel 34, and by that the rotary movement of the rod 16, becomes limited to 180°.

A spring 54 keeps together with a stop 56 the rod 16 in the position shown in FIGS. 1, 3 and 5.

When a bed-pan 20 shall be emptied and cleaned, it is placed in the holder 18 in non-emptying position according to FIG. 1. Then the lid 14 is closed and the cylinder 38 is activated, the piston rod 36 being pushed out so that the gear wheel 30 and the gear wheel 34 with the rod 16 and the bed-pan 20 are turned. In FIG. 3 the bed-pan has been turned 90°.

In FIG. 5 the bed-pan has been turned 180°. Sumultaneously the turning of the ben-pan around the axis 24 has been stopped by the stop 46. When the piston rod 36 is further pushed out, the bed-pan will be turned around the axis 26 down over a nozzle 58 to the position shown in FIG. 7. By this the nozzle 58 comes into the interior of the bed-pan and can spray cleaning liquid directly against all surfaces inside the bed-pan inclusive the inside of a brim 60 of the bed-pan shown in FIG. 3.

The cleaned bed-pan is returned from the position shown in FIG. 7 to the position shown in FIG. 1 by retracting of the piston rod 36, the spring 54 first raising the bed-pan until the stop 56 abuts the plate 28. After that the gear wheels 30 and 34 begin to rotate and will rotate until the pin 52 abuts the stop 44, the bed-pan again taking the position shown in FIG. 1.

The nozzle 58 can possibly also be arranged rotating around an axis 62 in order to further improve the cleaning effect.

I claim:

1. An apparatus for emptying and cleaning a bed pan and other hygenic containers comprising a receptacle, a holder arranged in the receptacle for receiving a bed pan or the like in an upright position, a motor-operated drive mechanism which when activated is arranged to turn said holder with said bed pan around a substantially horizontal first axis to an inverted position so that the contents of said bed pan are emptied into said receptacle, a second axis about which said first axis is rotatable in a substantially vertical plane, and a nozzle for spraying cleaning liquid against the interior of said turned bed pan wherein said motor-operated drive mechanism which when further activated moves said holder with said inverted bed pan along said vertical plane and over said nozzle so that the nozzle protrudes into the interior of said bed pan.

2. An apparatus as claimed in claim 1 wherein said inverted bed pan in said inverted position moves between a first upper position and a second lower position, and said second axis is positioned laterally from said receptacle.

3. An apparatus as claimed in claim 2 wherein said motor-operated drive mechanism rotates said holder substantially 180 degrees around said first axis and said motor-operated mechanism rotates said holder and bed pan around said bed pan so that the interior of said bed pan is moved over said nozzle.

4. An apparatus as claimed in claim 2 further comprising a first small gear wheel mounted on said holder and rotatable about a first axis, a second larger gear wheel rotatable about an axis being fixed relative to said first axis, said second gear wheel operatively engaging said first gear wheel, a stop means for limiting the movement of said first gear wheel, a spring connected to said holder whereby the first axis is located in said first position, and a rectilinearly extendable piston-cylinder arrangement acting on the circumference of said second gear wheel for rotating the same, said holder being rotated and said first axis being located in said first position when said piston is extended in said cylinder, and after which said stop means functions to stop the rotary movement about said first axis, and the force of said spring is overcome by said piston-cylinder arrangement whereby said holder with said bed pan will be rotated about said second axis until said first axis reaches said second position.

* * * * *